US011679588B2

(12) United States Patent
Kakiuchi

(10) Patent No.: US 11,679,588 B2
(45) Date of Patent: Jun. 20, 2023

(54) LIQUID DISCHARGING HEAD

(71) Applicant: BROTHER KOGYO KABUSHIKI KAISHA, Nagoya (JP)

(72) Inventor: Toru Kakiuchi, Chita (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 64 days.

(21) Appl. No.: 17/500,428

(22) Filed: Oct. 13, 2021

(65) Prior Publication Data

US 2022/0126574 A1 Apr. 28, 2022

(30) Foreign Application Priority Data

Oct. 28, 2020 (JP) ..... JP2020-180720

(51) Int. Cl.
*B41J 2/14* (2006.01)

(52) U.S. Cl.
CPC ..... *B41J 2/1433* (2013.01); *B41J 2/14201* (2013.01)

(58) Field of Classification Search
CPC ..... B41J 2/1433; B41J 2/14201; B41J 2002/14419; B41J 2202/12; B41J 2/14233
See application file for complete search history.

(56) References Cited

U.S. PATENT DOCUMENTS

2019/0283418 A1* 9/2019 Kato ..... B41J 2/155
2019/0291434 A1 9/2019 Uchida et al.
2020/0269574 A1 8/2020 Tsukahara et al.

FOREIGN PATENT DOCUMENTS

JP 2015-509454 A 3/2015
JP 2019-166705 A 10/2019
JP 2019-166718 A 10/2019
JP 2020-138373 A 9/2020
WO 2013/134322 A1 9/2013

OTHER PUBLICATIONS

IP.com search (Year: 2023).*

* cited by examiner

*Primary Examiner* — Lisa Solomon
(74) *Attorney, Agent, or Firm* — Kenealy Vaidya LLP

(57) ABSTRACT

A liquid discharging head includes: a first common channel, a second common channel; and individual channels. The individual channels have: nozzles aligned in a first direction; pressure chambers; descenders formed in a channel substrate arranged between a nozzle plate and a pressure chamber plate in a second direction orthogonal to the first direction; and a connecting channel. The connecting channel has: a first channel part formed in the nozzle plate, and a second channel part formed in the channel substrate, connected to the first channel part and having a length in the second direction which is shorter than that of the second common channel. The second common channel is formed in the channel substrate, overlaps with the descenders in a third direction orthogonal to both of the first direction and the second direction, and is partitioned from the descenders by a partition wall formed by the channel substrate.

14 Claims, 9 Drawing Sheets

LIQUID DISCHARGING HEAD

CROSS REFERENCE TO RELATED APPLICATIONS

The present application claims priority from Japanese Patent Application No. 2020-180720, filed on Oct. 28, 2020, the disclosure of which is incorporated herein by reference in its entirety.

BACKGROUND

The present disclosure relates to a liquid discharging head which discharges or ejects a liquid from a nozzle.

As an example of a liquid discharging head which discharges or ejects a liquid from a nozzle, there is known a liquid jetting head which has a configuration to be explained in the following and which jets or ejects a liquid from a plurality of nozzles. In this liquid jetting head, each of a plurality of pressure chambers communicating with a supply channel is connected to one of the plurality of nozzles via one of a plurality of communicating channels. Further, each of the plurality of communicating channels is connected to a recovered liquid chamber via one of a plurality of recovery channels. Further, the plurality of recovery channels are formed in a nozzle plate in which the plurality of nozzles are formed.

SUMMARY

In the above-described liquid jetting head, air flowed into each of the plurality of pressure chambers together with the liquid can be exhausted to the recovered liquid chamber via one of the plurality of recovery channels connected to a part, of one of the plurality of communicating channels, in the vicinity of one of the plurality of nozzles. However, in a case that a length of each of the plurality of recovery channels is long, the channel resistance in the recovery channel becomes to be great, which in turn leads to such a situation that the liquid does not flow smoothly to the recovered liquid chamber from the communicating channel via the recovery channel. In such a case, the above-described exhaust of the air cannot be performed smoothly.

On the other hand, in a case that the length of each of the plurality of recovery channels is made to be short in order to make the channel resistance in the recovery channel to be small, a partition wall separating each of the plurality of communicating channels from the recovered liquid chamber is made to be thin. In a case that pressure is imparted to the liquid inside a certain pressure chamber among the plurality of pressure chambers so as to eject or discharge the liquid from a certain nozzle corresponding to the certain pressure chamber, the change in the pressure in the liquid inside a certain communicating channel corresponding to the certain pressure chamber is transmitted, due to deformation of the thinned partial wall, to the liquid in another communicating channel corresponding to another pressure chamber different from the certain pressure chamber. Namely, there is a fear that a so-called crosstalk might arise.

Further, in the above-described liquid jetting head, the plurality of recovery channels are formed in the nozzle plate having a small thickness and the plurality of recovery channels are arranged side by side. Accordingly, it is also difficult to make either one of the length, of each of the plurality of recovery channels, in the thickness direction of the nozzle plate and the length, of each of the plurality of recovery channels, in a direction in which the plurality of recovery channels are arranged side by side to be long. Thus, it is also difficult to make the channel resistance in each of the plurality of recovery channels to be small by making the cross-sectional area of a cross section, of each of the plurality of recovery channels, orthogonal to the length direction thereof, to be great.

An object of the present disclosure is to provide a liquid discharging head in which the crosstalk is less likely to occur even configured to be smoothly exhaust the air inflowed into the channel(s).

According to an aspect of the present disclosure, there is provided a liquid discharging head including: a first common channel, a second common channel, and a plurality of individual channels which communicate with the first common channel and the second common channel. The plurality of individual channels have: nozzles formed in a nozzle plate and aligned in a first direction; pressure chambers which correspond to the nozzles respectively, which are formed in a pressure chamber plate and which communicate with the first common channel, the pressure chamber plate being arranged to be apart from the nozzle plate in a second direction orthogonal to the first direction; descenders which are formed in a channel substrate arranged between the nozzle plate and the pressure chamber plate in the second direction, and which are aligned in the first direction, each of the descenders extending in the second direction to connect one of the nozzles and one of the pressure chambers corresponding to the one of the nozzles; and at least one connecting channel which connects at least one of the descenders and the second common channel. The at least one connecting channel has: at least one first channel part formed in the nozzle plate, and a second channel part formed in the channel substrate, connected to the at least one first channel part and having a length in the second direction which is shorter than that of the second common channel. The second common channel is formed in the channel substrate, overlaps with the descenders in a third direction orthogonal to both of the first direction and the second direction, and is partitioned from the descenders by a partition wall formed by the channel substrate.

DETAILED DESCRIPTION

In the following, an embodiment of the present disclosure will be explained.

<Overall Configuration of Printer 1>

Figure 1:
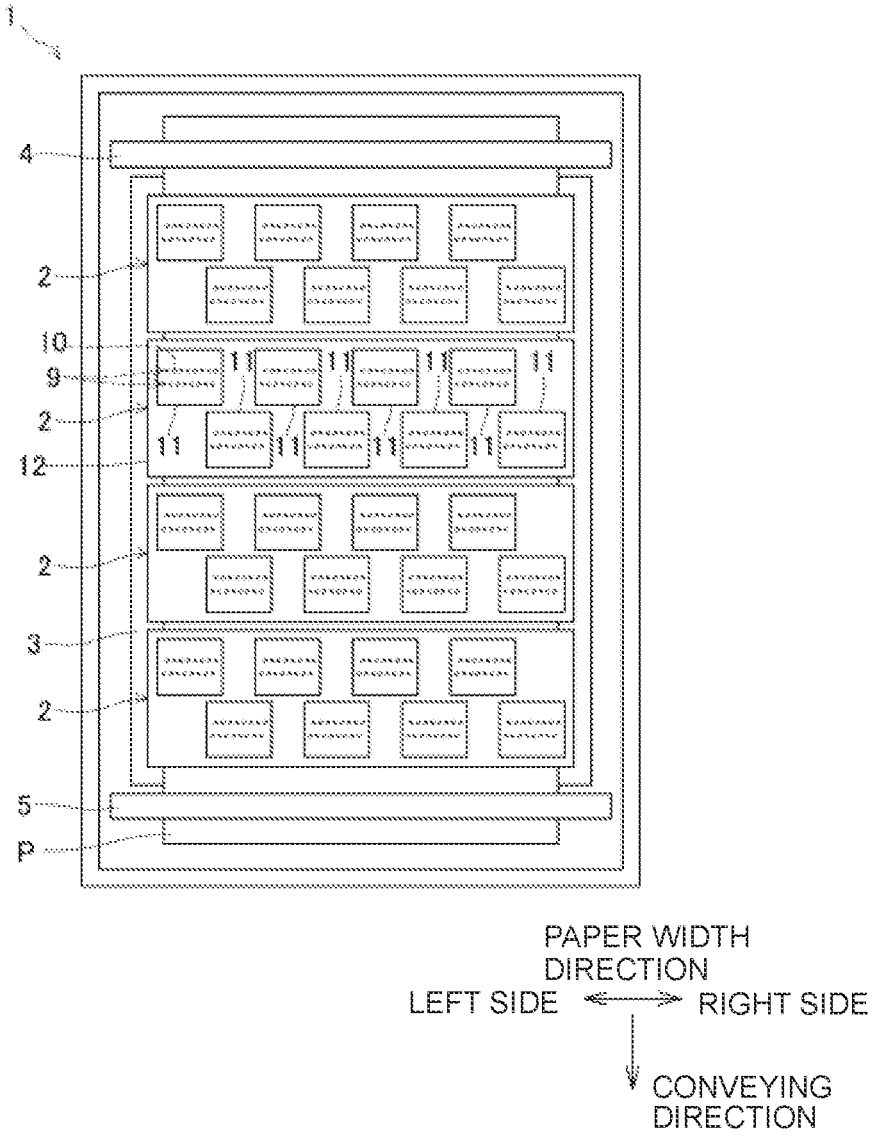
FIG. 1 is a view schematically depicting the configuration of a printer.
Figure 2:
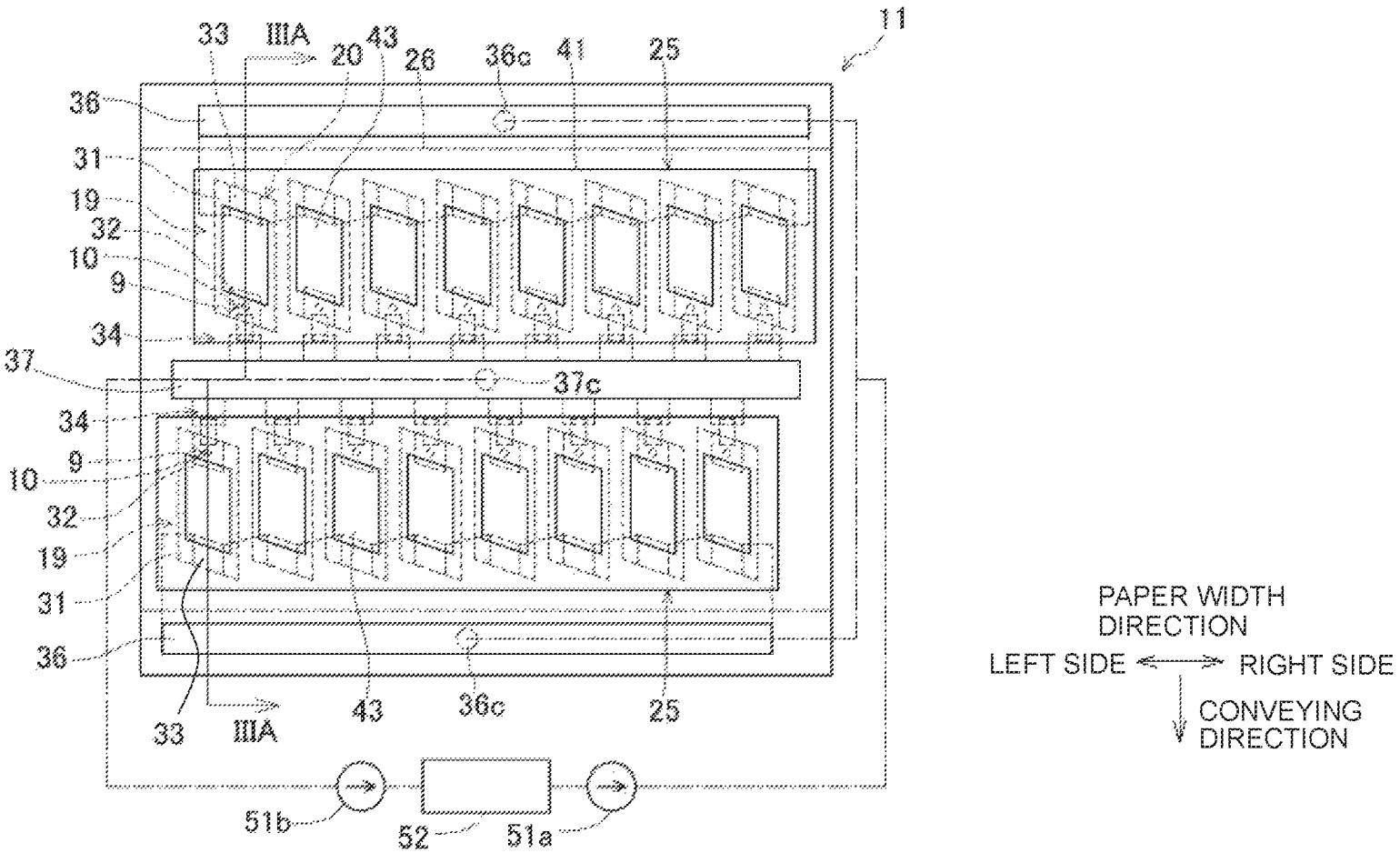
FIG. 2 is a plan view of a head provided on the printer depicted in FIG. 1.

As depicted in FIG. 1, a printer 1 according to the present embodiment is provided with four head units 2, a platen 3, and conveying roller pairs 4 and 5. The four head units 2 are arranged side by side in a horizontal conveying direction (a "third direction" of the present disclosure) in which a recording paper sheet (recording paper) P is conveyed by the conveying roller pairs 4 and 5, as will be described later on. Each of the four head units 2 is provided with eight pieces of a head 11 (a "liquid discharging head" of the present disclosure), and a head holding member 12.

Each of the eight pieces of the head 11 discharges or ejects an ink from a plurality of nozzles 10 formed in a lower surface thereof. The plurality of nozzles 10 are aligned in a paper width direction (a "first direction" of the present disclosure) which is horizontal and orthogonal to the conveying direction to thereby form a nozzle row (nozzle array) 9. Further, each of the eight heads 11 has two pieces of the nozzle row 9 arranged side by side in the conveying direction. In each of the eight heads 11, the two pieces of the nozzle row 9 include a nozzle row 9 located on the upstream side and a nozzle row 9 located on the downstream side in the conveying direction. Nozzles 10 constructing the nozzle row 9 located on the upstream side and nozzles 10 constructing the nozzle row 9 located on the downstream side in the conveying direction are shifted from one another in the paper width direction by a length half the spacing distance between the nozzles 10 in each of the nozzle rows 9.

Further, among the eight heads 11, four heads 11 are arranged side by side with a spacing distance therebetween in the paper width direction. Furthermore, the remaining four heads 11 among the eight heads 11 are arranged side by side with a spacing distance therebetween in the paper width direction, at a position shifted, to the downstream side in the conveying direction, from the above-described four heads 11. Moreover, positions in the paper width direction of the four heads 11 on the upstream side in the conveying direction are shifted from positions in the paper width direction of the four heads 11 on the downstream side in the conveying direction. With this, the plurality of nozzles 10 of the eight heads 8 which construct one head unit 2 among the four head units 2 are arranged over the entire length in the paper width direction of the recording paper sheet P.

The head holding member 12 is a rectangular plate-shaped member of which longitudinal direction is the paper width direction. The head holding member 12 holds the eight heads 11 in the above-described positional relationship.

Further, black, yellow, cyan and magenta inks are discharged or ejected from the plurality of nozzles 10 constructing the heads 11 constructing the four head units 2. The four head units 2 include a head unit of the black ink, a head unit of the yellow ink, a head unit of the cyan ink and a head unit of the magenta ink, which are arranged in this order from the upstream side in the conveying direction.

The platen 3 is arranged at a location below the four head units 2, and faces (is opposite to) the plurality of nozzles 10 of the four head units 2 in the vertical direction (a "second direction" of the present disclosure). The platen 3 extends in the paper width direction over the entire length of the recording paper sheet P, extends in the conveying direction over the four head units 2, and supports the recording paper sheet P from therebelow.

The conveying roller pair 4 is arranged on the upstream side in the conveying direction of the four head units 2. The conveying roller pair 5 is arranged on the downstream side in the conveying direction of the four head units 2. Each of the conveying roller pairs 4 and 5 is constructed of two rollers which are arranged side by side in the vertical direction; the conveying roller pairs 4 and 5 rotate in a state that each of the conveying roller pairs 4 and 5 pinches the paper sheet P by the two rollers to thereby convey the paper sheet P in the conveying direction.

Further, in the printer 1, it is possible to perform recording on the paper sheet P by ejecting or discharging the inks from the plurality of nozzles 10 of the eight heads 11 constructing each of the four head units 2 while conveying the paper sheet P in the conveying direction by the conveying roller pairs 4 and 5.

<Configuration of Head 11>

Next, the configuration of each of the heads 11 will be explained. As depicted in FIGS. 2, 3A, 3B and 4, each of the heads 11 is provided with a channel substrate 21, a nozzle plate 22, two dumper plates 23 and a pressure chamber plate 24.

The channel substrate 21 is a member having a shape of a rectangular parallelepiped and formed of silicon. The nozzle plate 22 is formed of silicon, is arranged at a central part in the conveying direction of the lower surface of the channel substrate 21, and extends in the paper width direction substantially over the entire length of the channel substrate 21.

The two damper plates 23 are formed, for example, of a synthetic resin material, etc., are arranged, respectively, at end parts on the upstream side and the downstream side in the conveying direction of the lower surface of the channel substrate 21, and extend in the paper width direction substantially over the entire length of the channel substrate 21. The two damper plates 23 are thinner, for example, than the nozzle plate 22, etc., and are elastically deformed so as to suppress any fluctuation or variation in pressure of the ink in a first common channel 36 which will be described later on.

The pressure chamber plate 24 is formed of silicon, and is arranged on the upper surface of the channel substrate 21. With this, the pressure chamber plate 24 is arranged on an upper side ("one side in the second direction" of the present disclosure) of the nozzle plate 22, and the channel substrate 21 is arranged between the nozzle plate 22 and the pressure chamber plate 24.

A stacked body of the channel substrate 21, the nozzle plate 22, the damper plates 23 and the pressure chamber plate 24 are formed with the plurality of nozzles 10, a plurality of pressure chambers 31, a plurality of descenders 32, a plurality of first throttles 33 and a plurality of second throttles 34.

The plurality of nozzles 10 are formed in the nozzle plate 22, and form the above-described two nozzle rows 9. The plurality of pressure chambers 31 are formed in the pressure chamber plate 24. Each of the plurality of pressure chambers 31 is provided individually with respect to one of the plurality of nozzles 10, and an end part on the inner side in the conveying direction of each of the plurality of pressure chambers 31 is overlapped in the vertical direction with one of the plurality of nozzles 10 corresponding thereto. Further, each of the plurality of pressure chambers 31 has a projection shape which is formed by projecting the pressure chamber 31 in the vertical direction and which is a parallelogram with the conveying direction as the longitudinal direction thereof and having a pair of opposed side parallel to the conveying direction. Furthermore, the plurality of pressure chambers 31 are formed in the pressure chamber plate 24 at a part or portion which is different from an upper end part of the pressure chamber plate 24. A part, of the upper end part of the pressure chamber plate 24, which extends over the plurality of pressure chambers 31 is a vibration plate 24*a* covering the plurality of pressure chambers 31.

The plurality of descenders 32 are formed in the channel substrate 21. Each of the plurality of descenders 32 is formed for every combination or set of a nozzle 10 and a pressure chamber 31, which correspond to each other. Each of the plurality of descenders 32 extends to penetrate the channel substrate 21 in the vertical direction and connects a nozzle 10 corresponding thereto and the end part on the inner side in the conveying direction of a pressure chamber 31 corresponding thereto. The descenders 32 are aligned in the paper width direction.

Further, each of the plurality of descenders 32 has a projection shape which is formed by projecting the descender 32 in the vertical direction and which is a parallelogram; and inner wall surfaces 32*a* on the both sides in the paper width direction forming a pair of opposed sides of the parallelogram are parallel to the conveying direction.

Each of the plurality of first throttles 33 is provided individually with respect to one of the plurality of pressure chambers 31. Each of the plurality of first throttles 33 extends in the vertical direction at an upper part of the channel substrate 21, and is connected, at an upper end thereof, to an end part on the outer side in the conveying direction of one of the plurality of pressure chambers 31 corresponding thereto. Further, each of the plurality of first throttles 33 has a projection shape which is formed by projecting the first throttle 33 in the vertical direction and which is a parallelogram having a pair of opposed sides parallel to the conveying direction.

Each of the plurality of second throttles 34 is provided individually with respect to one of the plurality of descenders 32. Each of the plurality of second throttles 34 has a first channel part 34*a* and a second channel part 34*b*.

The first channel part 34*a* is formed in an upper part of the nozzle plate 22. The first channel part 34*a* extends parallel to the conveying direction, and an end part, of the first channel part 34*a*, on the outer side in the conveying direction is connected to a lower end of one of the plurality of descenders 32 corresponding thereto.

The second channel part 34*b* is formed in a lower part of the channel substrate 21. The second channel part 34*b* extends in the conveying direction, and an end part, of the second channel part 34*b*, on the outer side in the conveying direction is connected to an end on the inner side in the conveying direction of the first channel part 34*a*.

Figure 3A:
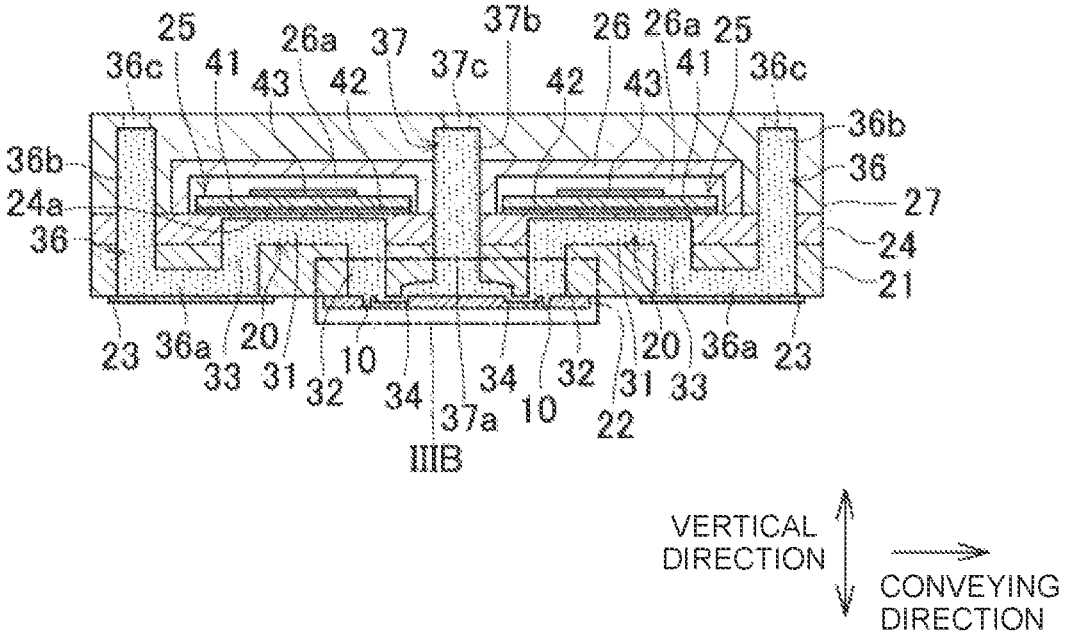
FIG. 3A is a cross-sectional view taken along a line IIIA-IIIA in FIG. 2.
Figure 3B:
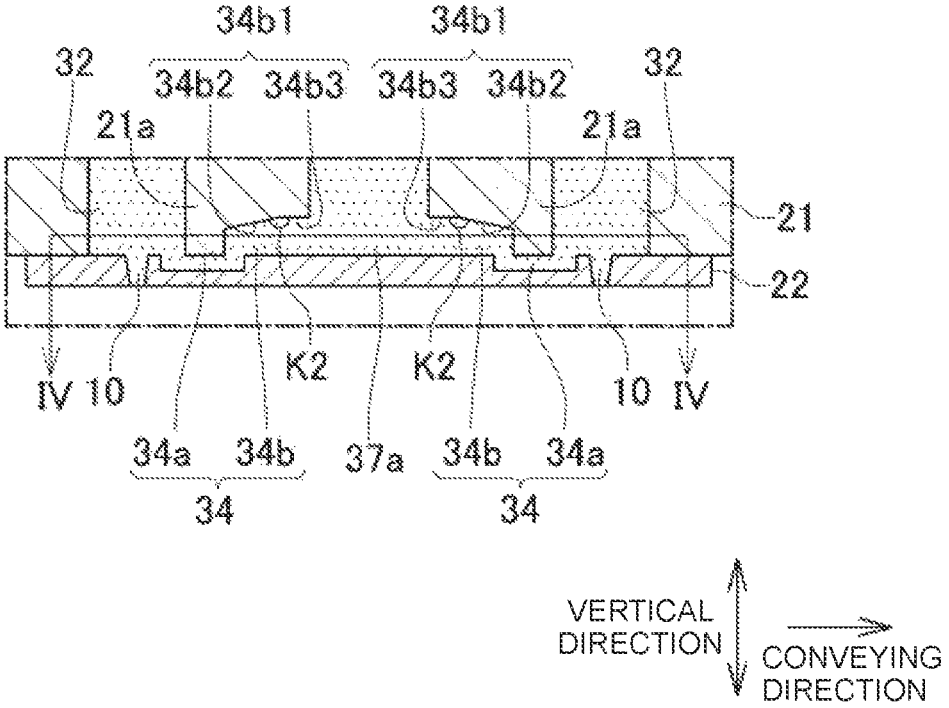
FIG. 3B is an enlarge view of a IIIB part in FIG. 3A.
Figure 4:
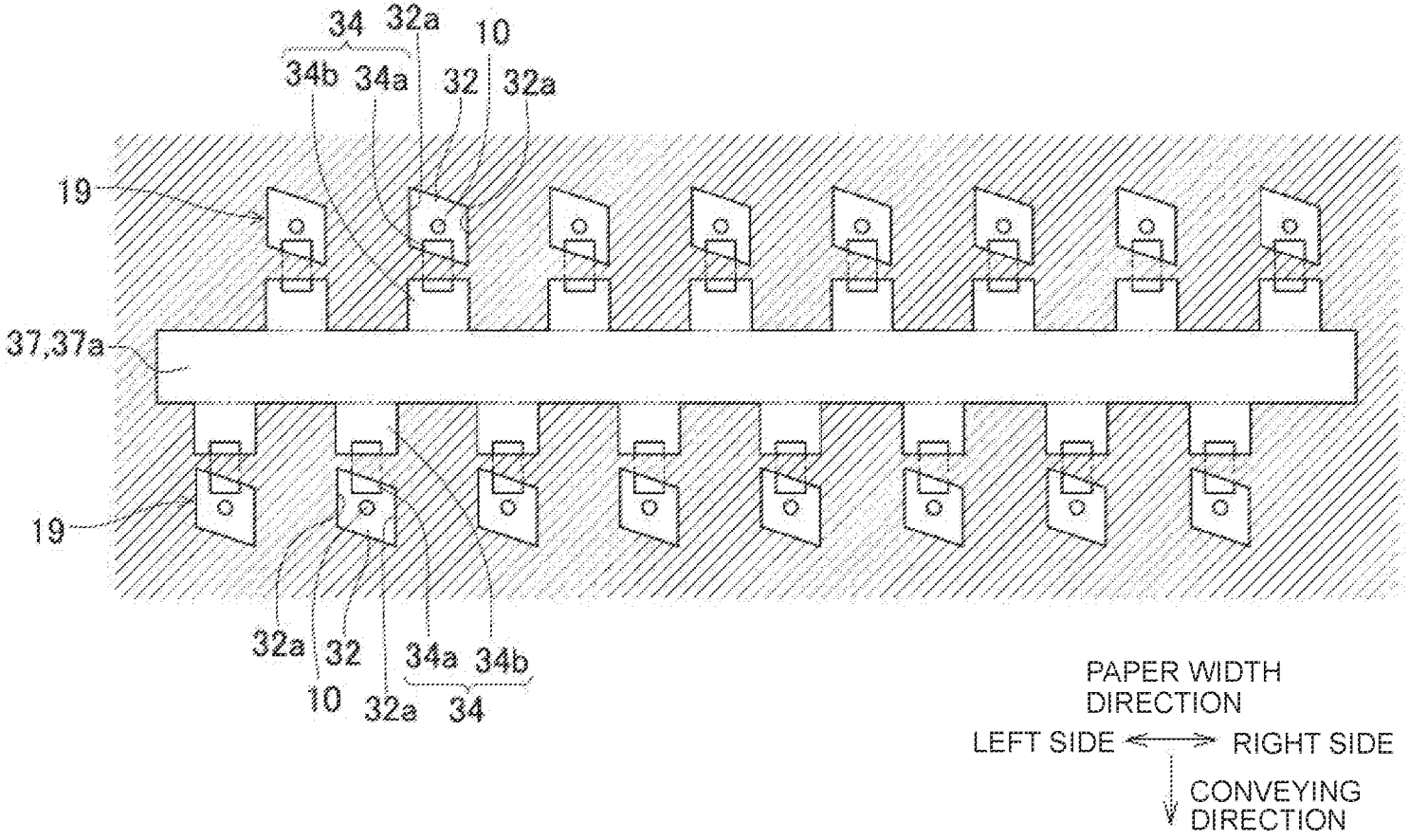
FIG. 4 is a cross-sectional view taken along a line IV-IV in FIG. 3B.

An inner wall surface of the second channel part 34*b* includes a ceiling surface 34*b*1 which is on a side of the pressure chamber plate 24 in the vertical direction. The ceiling surface 34*b*1 of the second channel part 34*b* has an inclined surface 34*b*2 and a connecting surface 34*b*3 in a cross section orthogonal to the paper width direction. The inclined surface 34*b*2 is inclined with respect to the conveying direction so that the inclined surface 34*b*2 is inclined toward the upper side (approaching closer to the pressure chamber plate 24) as the inclined surface 34*b*2 approaches closer to the inner side in the conveying direction (closer toward a second common channel 37 which will be described later on). The connecting surface 34*b*3 is connected to an end on the inner side in the conveying direction of the inclined surface 34*b*2. Further, an angle K2 formed between the inclined surface 34*b*2 and the connecting surface 34*b*3 is an obtuse angle (for example, an angle in a range of approximately not less than 110 degrees to approximately less than 180 degrees). As depicted in FIG. 3B, the angle K2 is a smaller angle of the angles formed between the inclined surface 34*b*2 and the connecting surface 34*b*3. Here, the connecting surface 34*b*3 may be, for example, a surface parallel to the conveying direction. Alternatively, it is allowable that the connecting surface 34*b*3 is a surface which is inclined with respect to the conveying direction so that the connecting surface 34*b*3 is inclined toward the upper side as the connecting surface 34*b*3 approaches closer to the inner side in the conveying direction, and that an angle of the connecting surface 43*b*3 with respect to the conveying direction is smaller than that of the inclined surface 34*b*2.

Further, in the present embodiment, each of the plurality of the second throttles 34 has the above-described configuration to thereby make the channel resistance in the second throttle 34 formed of the first channel part 34*a* and the second channel part 34*b* to be smaller than the channel resistance in one of the plurality of nozzles 10. For example, the channel resistance in the nozzle 10 is approximately $4\times10^{13}$ Pa·s/m$^3$, whereas the channel resistance in the second throttle 34 is approximately $2\times10^{13}$ Pa·s/m$^3$.

Furthermore, in the head 11, a nozzle 10, a pressure chamber 31, a descender 32, a first throttle 33 and a second throttle 34 which correspond to one another form an individual channel 20. Moreover, in the head 11, whereas the plurality of nozzles 10 form the two nozzle rows 9, a plurality of pieces of the individual channel 20 are aligned in the paper width direction to thereby form two individual channel rows 19. The two individual channel rows 19 are arranged side by side in the conveying direction. Note that in the present embodiment, each of the second throttles 34, of the individual channels 20 which construct each of the individual channel rows 19, corresponds to a "connecting channel" of the present disclosure. In the present embodiment, there are a plurality of the connecting channel (the second throttles 34) each of which corresponds to one of the plurality of descender 32. Each of the plurality of connecting channels has one piece of the first channel part 34*a* connected to the descender 32 corresponding thereto, and one piece of the second channel part 32*b* connecting one piece of the first channel part 34*a* and the second common channel 37.

Further, the stacked body of the channel substrate 21, the nozzle plate 22, the two damper plates 23 and the pressure chamber plate 24 are further formed with two lower side channel parts 36*a* which are lower parts of two first common channels 36, respectively, and one lower side channel part 37*a* which is a lower part of one second common channel 37, in addition to the plurality of individual channel 20 as described above.

The two lower side channel parts 36*a* are provided corresponding to the two individual channel rows 19, respectively. Each of the two lower side channel parts 36*a* is located on the outer side in the conveying direction of one of the two individual channel rows 19 corresponding thereto. Each of the two lower side channel parts 36*a* extends in the paper width direction over the individual channels 20 constructing one of the two individual channel rows 19 corresponding thereto. Further, a part, of each of the two lower side channel parts 36*a*, which is different from an end part on the outer side in the conveying direction is formed in the lower part of the channel substrate 21, and a lower end of the first throttle 33 of each of the individual channels 20 constructing one of the individual channel rows 19 is connected to the lower side channel part 36*a*.

Further, each of the two lower side channel parts 36*a* extends to penetrate the channel substrate 21 and the pressure chamber plate 24 in the vertical direction, at the end part on the outer side in the conveying direction thereof. Furthermore, each of the above-described two damper plates 23 forms a wall on the lower side of one of the two lower side channel parts 36*a*; each of the above-described two damper plates 23 is elastically deformed to thereby suppress the fluctuation or variation in the pressure of the ink inside one of the two lower side channel parts 36*a*.

The lower side channel part 37*a* is arranged between the two individual channel rows 19 in the conveying direction, and extends to penetrate the channel substrate 21 and the pressure chamber plate 24 in the vertical direction. With this, a length in the vertical direction of the second channel part 34*b* is shorter than a length in the vertical direction of the second common channel 37. Further, the lower side channel part 37*a* arranged in such a manner overlaps with the plurality of descenders 32 in the conveying direction, and a part, of the channel substrate 21, which is located between the lower side channel part 37*a* and the plurality of descenders 32 in the conveying direction is a partition wall 21*a* partitioning (separating) the lower side channel part 37*a* with respect to the plurality of descenders 32. Furthermore, an end on the inner side in the conveying direction of the second channel part 34*b* in each of the plurality of individual channels 20 constructing the two individual channel rows 19 is connected to the lower side channel part 37*a*.

Moreover, each of the eight heads 11 is provided further with two piezoelectric actuators 25, a protective substrate 26 and a cover member 27, in addition to the channel substrate 21, the nozzle plate 22, the two damper plates 23 and the pressure chamber plate 24.

The two piezoelectric actuators 25 corresponds to the two individual channel rows 19, respectively. Each of the two piezoelectric actuators 25 is provided with a piezoelectric layer 41, a common electrode 42 and a plurality of individual electrodes 43.

The piezoelectric layer 41 is formed of a piezoelectric material composed primarily of lead zirconate titanate, which is a mixed crystal of lead titanate and lead zirconate, is arranged on the upper surface of the pressure chamber plate 24 (vibration plate 24*a*), and extends in the paper width direction over the pressure chambers 31 constructing the individual channel row 19 corresponding to the piezoelectric layer 41.

The common electrode 42 extends between the pressure chamber plate 24 (vibration plate 24*a*) and the piezoelectric layer 41 over the entire areas thereof. The common electrode 42 is connected to a non-illustrated power source via a non-illustrate wiring member, etc., and is maintained at the ground potential. The plurality of individual electrodes 43 are arranged on the upper surface of the common electrode 41. Each of the plurality of individual electrodes 43 corresponds to one of the pressure chambers 31, and overlaps, in the vertical direction, with a central part of one of the pressure chambers 31 corresponding thereto. The plurality of individual electrodes 43 is connected to a non-illustrated driver IC via a non-illustrated wiring member, etc. Either one of the ground potential or a predetermined driving potential (for example, a potential in a range of approximately 20V to approximately 30V) is selectively applied to each of the plurality of individual electrodes 43 by the driver IC.

Further, corresponding to such an arrangement of the common electrode 42 and the plurality of individual electrodes 43, parts, of the piezoelectric layer 41, each of which is sandwiched between one of the plurality of individual electrodes 43 and the common electrode 42 are polarized in the vertical direction.

Here, an explanation will be given about a method of causing the piezoelectric actuator 25 to eject or discharge an ink from each of the plurality of nozzles 10. In the piezoelectric actuator 25, in a case that the ink is not discharged from the plurality of nozzles 10, the ground potential is applied to all the individual electrodes 43. In a case of causing the ink to be discharged from a certain nozzle 10, among the plurality of nozzles 10, the potential of a certain individual electrode 43, included in the plurality of individual electrodes 43 and corresponding to the certain nozzle 10, is switched from the ground potential to the driving potential. Then, an electric field parallel to the polarization direction is generated in a part, of the piezoelectric layer 41, which is sandwiched by the certain individual electrode 43 and the common electrode 42. Due to this electric field, the above-described part of the piezoelectric layer 41 contracts in a horizontal direction (the paper width direction and the conveying direction) which is orthogonal to the polarization direction, thereby deforming parts, of the vibration plate 24*a* and the piezoelectric layer 41, respectively, which overlap with a certain pressure chamber 31, to project toward the side of the certain pressure chamber 31. As a result, the deformation decreases the volume of the certain pressure chamber 31, which in turn increase the pressure of the ink inside the certain pressure chamber 31, thereby discharging the ink from the certain nozzle 10 communicating with the certain pressure chamber 31. Further, after the discharge or ejection of the ink from the certain nozzle 10, the potential of the certain individual electrode 43 is returned from the driving potential to the ground potential. With this, the vibration plate 24*a* and the piezoelectric layer 41 are returned to the states thereof before the deformation.

The protective substrate 26 is formed of silicon, is arranged on the upper surface of the pressure chamber plate 24 on which the two piezoelectric actuators 25 are arranged, and covers the two piezoelectric actuators 25. More specifically, recessed parts 26*a* are formed, in the lower surface of the protective substrate 26, respectively at portions overlapping in the vertical direction with the two piezoelectric actuators 25. Further, the piezoelectric actuators 25*a* are accommodated in the recessed parts 26*a*, respectively.

The cover member 27 is arranged on the upper surface of the pressure chamber plate 24 on which the two piezoelectric actuators 25 and the protective substrate 26 are arranged, and covers the two piezoelectric actuators 25 and the protective substrate 26.

Further, two upper side channel parts 36*b* constructing upper parts of the two first common channels 36, respectively, are formed in the cover member 27. Each of the two upper side channel parts 36*b* overlaps in the vertical direction with one of the two lower side channel parts 36*a*, and extends in the paper width direction over the entire length of one of the two lower side channel parts 36*a*. Further, each of the two upper side channel parts 36*b* extends in the vertical direction over a part, of the cover member 27, which is different from an upper end part of the cover member 27. Furthermore, two connection ports 36*c* which extend up to an upper end of the cover member 27 are each formed in a central part in the paper width direction of one of the two upper side channel parts 36*b* corresponding thereto.

Further, the two connection ports 36*c* provided on the two first common channels 36, respectively, are connected to a pump 51*a* via a non-illustrated tube, etc. Furthermore, the pump 51*a* is connected to an ink tank 52. The pump 51*a* feeds the ink toward the connection ports 36*c* from the ink tank 52.

Moreover, an upper side channel part 37*b*, which is an upper part of the second common channel 37, is formed in the protective substrate 26 and the cover member 27. The upper side channel part 37*b* overlaps with the lower side channel part 37*a* in the vertical direction, and extends in the paper width direction over the entire length of the lower side channel part 37*a*. Further, the upper side channel part 37*b* extends in the vertical direction over a part, of the cover member 27, which is different from the upper end part thereof, and over the protective substrate 26. Furthermore, a connection port 37*c*, which extends up to the upper end of the cover member 37, is provided on a central part in the paper width direction of the upper side channel part 37*b*.

The connection port 37*c* is connected to a pump 51*b* via a non-illustrated tube, etc. Furthermore, the pump 51*b* is connected to the ink tank 52. The pump 51*b* feeds the ink toward the ink tank 52 from the connection port 37*c*.

Moreover, in the present embodiment, in a case that the pumps 51*a* and 51*b* are driven, the ink inside the ink tank 52 flows, via the non-illustrated tube, etc., into the two first common channels 36 from the two connection ports 36*c*. Further, the ink inflowed into each of the two first common channels 36 flows into the plurality of individual channels 20 from the first throttles 33. The ink flowed into each of the individual channels 20 flows out to the second common channel 37 from the second throttles 34. The ink flowed into the second common channel 37 flows out from the connection port 37*c*, and returns to the ink tank 52 via the non-illustrated tube. In such a manner, in the present embodiment, it is possible to circulate the ink between each of the heads 11 and the ink tank 52.

Note that one pump among the pumps 51*a* and 51*b* may be omitted. Even in such a case, the other of the pumps 51*a* and 51*b* is driven to thereby make it possible to circulate the ink between each of the heads 11 and the ink tank 52, in a similar manner to that described above.

<Effects>

In the present embodiment, the second throttle 34 has the first channel part 34*a* formed in the nozzle plate 22 and the second channel part 34*b* formed in the channel substrate 21. With this, it is possible to make the channel resistance in the second throttle to be small, while allowing the second throttle to have a long length, as compared with a case of forming the entirety of the second throttle in the nozzle plate 22. With this, it is possible to secure the thickness (thickness in the conveying direction) of the partition wall 21*a* between the descender 32 and the second common channel 37, thereby making it possible to make the crosstalk to less likely to occur, while allowing any air in the ink to be exhausted smoothly from the descender 32 into the second common channel 37.

Further, in the present embodiment, the length in the vertical direction of the second channel part 34*b* is shorter than the length in the vertical direction of the second common channel 37. Accordingly, it is possible to secure the thickness of the partition wall 21*a* between the descender 32 and the second common channel 37. Further, it is possible to make the length of the first channel part 34*a* to be short, and to suppress such a situation that the channel resistance in the second throttle 34 becomes to be unnecessarily great.

Furthermore, in the present embodiment, the ceiling surface 34*b*1 of the second channel part 34*b*1 has the inclined surface 34*b*2 which is inclined with respect to the conveying direction so that the inclined surface 34*b*2 is inclined toward the upper side as the inclined surface 34*b*2 approaches closer toward the second common channel 37. With this, it is possible to allow an air bubble inside the second channel part 34*b* to flow smoothly toward the second common channel 37 along the inclined surface 34*b*2.

Moreover, in the present embodiment, the ceiling surface 34*b*1 of the second channel part 34*b* has the inclined surface 34*b*2 which is inclined with respect to the conveying direction as described above and the connecting surface 34*b*3 connected to the end, in the conveying direction of the inclined surface 34*b*2, on the side of the second common channel 37; the angle formed between the inclined surface 34*b*2 and the connecting surface 34*b*3 is made to be the obtuse angle. With this, it is possible to make any air bubble to less likely to accumulate in a connection part at which the inclined surface 34*b*2 and the connection surface 34*b*2 are connected to each other.

Further, in the present embodiment, each of the plurality of second throttles 34 is provided individually with respect to one of the plurality of descenders 32. Namely, one piece of the second throttle 34 is provided with respect to one piece of the descender 32. With this, there is provided such a configuration that the plurality of descenders 32 are communicated with one another only via the second common channel 37. Accordingly, it is possible to make a so-called fluid crosstalk to less likely to occur. The fluid crosstalk is a phenomenon as described below. In the fluid crosstalk, the pressure imparted by the piezoelectric actuator 25 to the ink inside a certain pressure chamber 31 and transmitted to the ink inside a certain second throttle 34 corresponding to the certain pressure chamber 31 is propagated to the ink inside another pressure chamber 31 via another second throttle 34.

Furthermore, in the present embodiment, the channel resistance in the second throttle 34 is smaller than the channel resistance in the nozzle 10. With this, it is possible to allow the ink to flow easily from the descender 32 into the second common channel 37 in a case that the ink is circulated between the head 11 and the ink tank 52, and to make the ink to less likely to leak from the nozzle 10.

<Modifications>

In the foregoing, the embodiment of the present disclosure has been explained. The present disclosure, however, is not limited to or restricted by the above-described embodiment; it is allowable to make a various kind of changes to the present disclosure, within the scope described in the claims.

In the above-described embodiment, the channel resistance in the second throttle 34 is made to be smaller than the channel resistance in the nozzle 10. The present disclosure, however, is not limited to this. It is allowable, for example, that the channel resistance in the second throttle 34 is not less than the channel resistance in the nozzle 10, under a condition that the channel resistance in the second throttle 34 is in a range by which the ink is not leaked from the nozzle 10 in a case that the ink is circulated between the head 11 and the ink tank 52 as described above.

Further, in the above-described embodiment, the ceiling surface 34*b*1 of the second channel part 34*b* has the inclined surface 34*b*2 which is inclined with respect to the conveying direction so that the inclined surface 34*b*2 is inclined toward the upper side as the inclined surface 34*b*2 approaches closer toward the second common channel 37 in the conveying direction (the direction of the length of the second channel part 34*b*), and the connecting surface 34*b*3 which is connected to the end on the side of the second common channel 37 in the conveying direction of the inclined surface 34*b*2, and the angle K2 formed between the inclined surface 34*b*2 and the connecting surface 34*b*3 is the obtuse angle. The present disclosure, however, is not limited to this.

It is allowable, for example, that the ceiling surface 34*b*1 does not have the connecting surface 34*b*3, and that the inclined surface 34*b*2 extends up to an end on the side of the second common channel 37 in the conveying direction of the second channel part 34*b*.

Alternatively, it is allowable, for example, that the ceiling surface 34*b*1 extends parallel to the conveying direction over the entire length in the conveying direction of the second channel part 34*b*.

Still alternatively, although each of the plurality of pieces of the second channel part 34*b* is provided individually with respect to one of the plurality of pieces of the first channel part 34*a*, the present disclosure is not limited to this.

Figure 5:
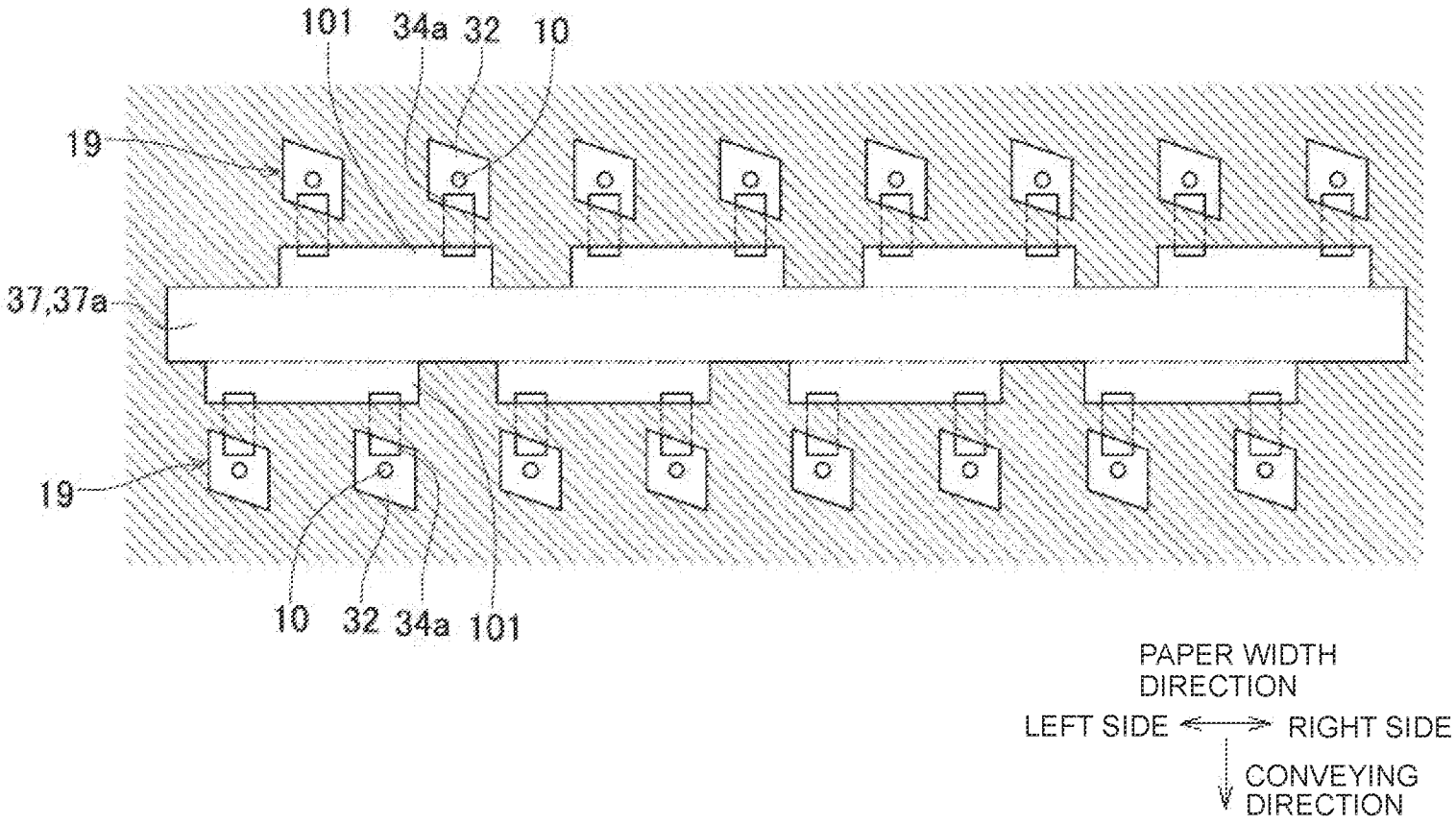
FIG. 5 is a cross-sectional view of a part of the head provided on the printer, and corresponding to FIG. 4.

In a first modification, as depicted in FIG. 5, one piece of connecting channel (two pieces of the first channel part 34*a* and one piece of second channel part 101) is provided with respect to two piece of the descenders 32. The second channel part 101 corresponds to two pieces of the first channel part 34*a* which are adjacent to each other in the paper width direction. Further, each of the plurality of second channel parts 101 extends in the paper width direction along two first channel parts 34*a* corresponding thereto. Each of the plurality of second channel parts 101 extends in the paper width direction over a range in which the two first channel parts 34*a* corresponding thereto are present. Each of the plurality of second channel parts 101 connects the two first channel parts 34*a* corresponding thereto to the second common channel 37. Note that in the first modification, a plurality of pieces of the first channel part 34*a* and a plurality of pieces of the second channel part 101 which correspond to each of the two individual channel rows 19 are collectively correspond to the "connecting channel" of the present disclosure. Namely, in the first modification, there is the connecting channel corresponding to two individual channels 20 which are included in the plurality of individual channels 20 and which are adjacent to each other in the paper width direction. FIG. 5 depicts 8 (eight) pieces of pairs of the individual channels, and 8 (eight) pieces of the connecting channel (34*a*, 101) each of which corresponds to one of the eight pieces of pairs of the individual channels. Each of the eight pieces of the connecting channel has two pieces of the first channel part 34*a* each of which is connected to the descender 32 of one of the two individual channels 20 corresponding thereto, and one piece of the second channel part 101 connecting the two pieces of the first channel part 34*a* and the second common channel 37.

In the first modification, it is possible to make the channel resistance in the connecting channel to be smaller than that in the case of the above-described embodiment. With this, it is possible to allow the ink to flow smoothly from the descender 32 into the second common channel 37 in a case that the ink is circulated between the head 11 and the ink tank 52.

Further, in the first modification, although each of the plurality of second channel parts 101 is provided for every two pieces of the first channel part 34*a* which are adjacent to each other in the paper width direction, it is allowable that the second channel part is provided for every not less than 3 (three) pieces of the first channel part 34*a* which are adjacent to one another in the paper width direction.

Figure 6:
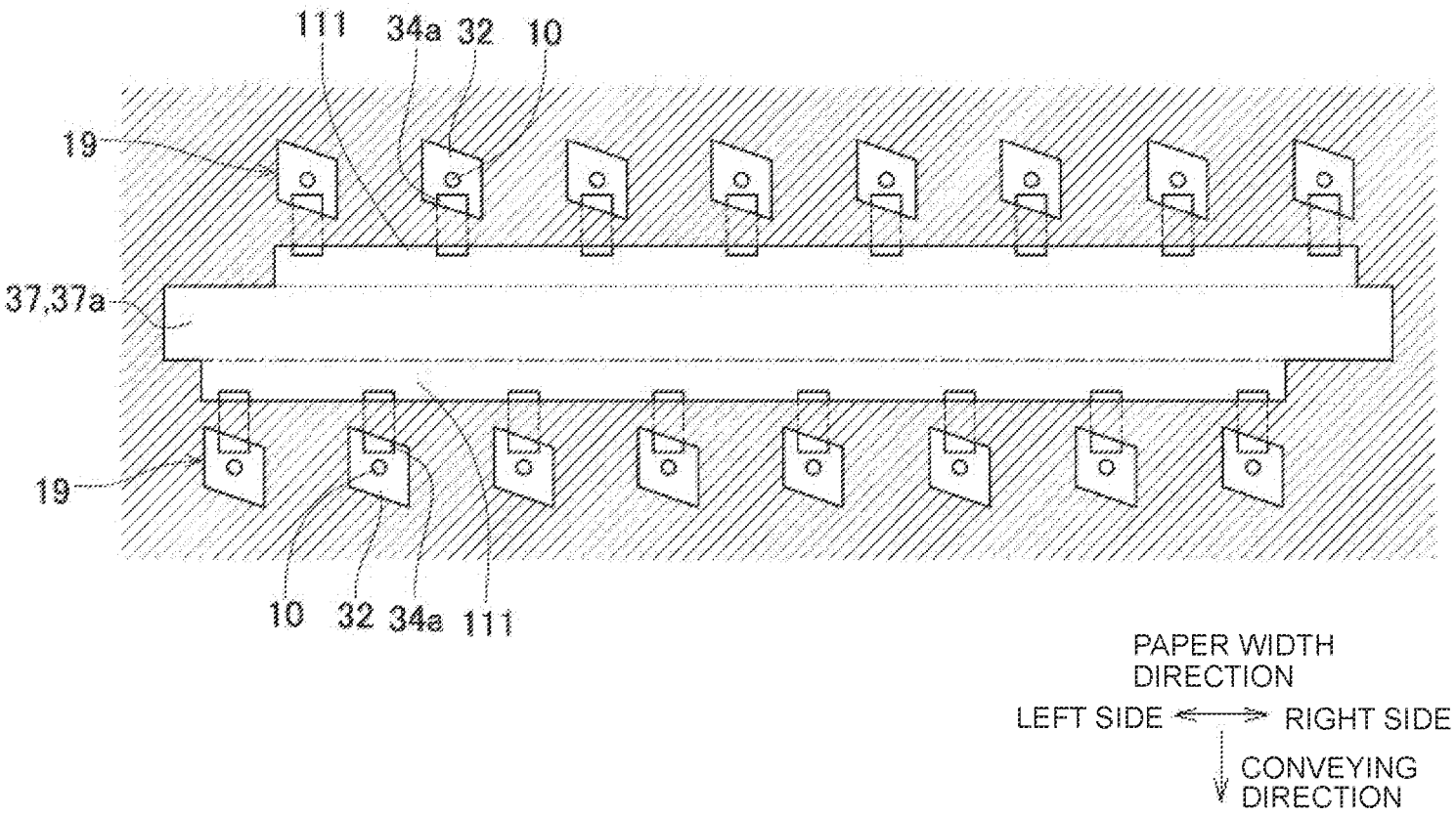
FIG. 6 is a cross-sectional view of a part of the head provided on the printer, and corresponding to FIG. 4.

In a second modification, as depicted in FIG. 6, one piece of connecting channel (the plurality of the first channel part 34*a* and one piece of second channel part 111) is provided with respect to all of the descenders 32 which are aligned in the paper width direction. The second channel part 111 is provided with respect to all of the plurality of pieces of the first channel part 34*a* constructing the plurality of individual channels 20 which construct each of the individual channel rows 19. Further, the second channel part 111 extends in the paper width direction over all the plurality of pieces of the first channel part 34*a* of the plurality of individual channels 20 which construct each of the individual channel rows 19 corresponding thereto. The second channel part 111 extends, in the paper width direction, over a range in which all the first channel parts 34*a* corresponding thereto are present. The second channel part 111 connects these first channel parts 34*a* and the second common channel 37. Note that in the second modification, a plurality of pieces of the first channel part 34*a* and one second channel part 111 which correspond to each of the two individual channel rows 19 are collectively correspond to as the "connecting channel" of the present disclosure.

Namely, in the second modification, there is one piece of the connecting channel corresponding to all of the plurality of pieces of the individual channels 20 which construct one piece of the individual channel rows 19 and which are aligned in the paper width direction. FIG. 6 depicts two pieces of the individual channel row 19 and two pieces of the connecting channel (34*a*, 111) corresponding thereto, respectively. Each of the two connecting channels has a plurality of pieces of the first channel part 34*a* each of which is connected to the descender 32 of one of all the individual channels 20 corresponding thereto, and one piece of the second channel part 111 connecting the plurality of pieces of the first channel part 34*a* and the second common channel 37.

In the second modification, it is possible to make the channel resistance in the connecting channel to be further smaller than that in the case of the first modification. With this, it is possible to allow the ink to flow smoothly from the descender 32 into the second common channel 37 in a case that the ink is circulated between the head 11 and the ink tank 52.

Further, in the above-described embodiment, first modification and second modification, the first channel part 34*a* formed in the nozzle plate 22 is connected to the descender 32, and the second channel part 34*b*, 101, 111 formed in the channel substrate 21 is connected to the second common channel 37. With this, it is possible to make the second channel part to be provided individually with respect to each of the descenders 32 as in the above-descried embodiment, or to make the second channel part to be provided commonly with respect to two or more pieces of the descender 32, as in the first and second modifications. With this, it is possible to make the freedom of design of the second common channel to be high, as compared with a case of connecting the second channel part to the descender 32, as in a third modification which is to be described later on.

Furthermore, in the foregoing example, although the first channel part formed in the nozzle plate 22 is connected to the descender 32, and the second channel part formed in the channel substrate 21 is connected to the second common channel 37, the present disclosure is not limited to this.

Figure 7A:
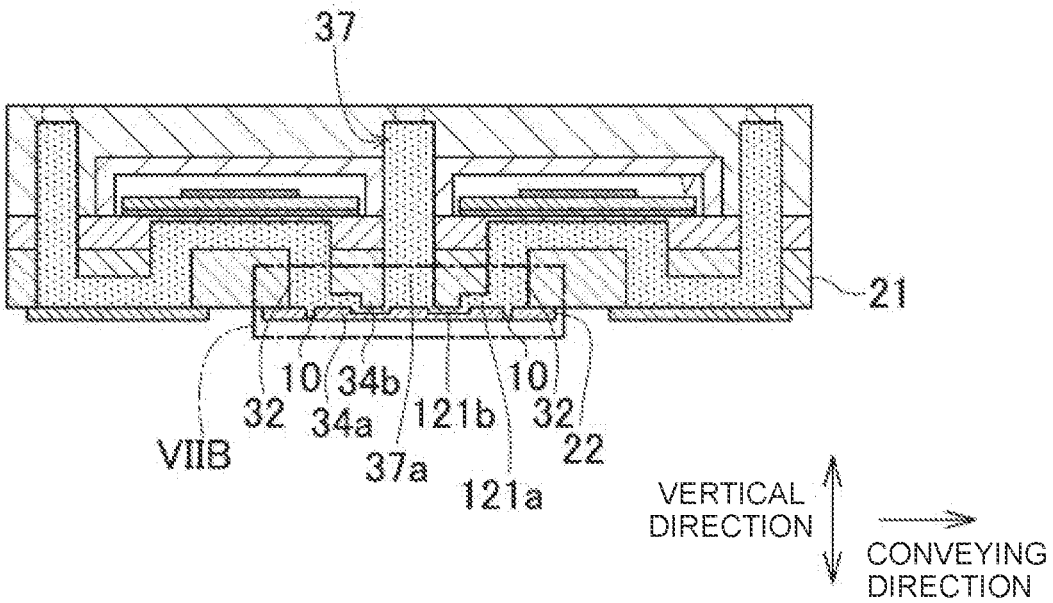
FIG. 7A is a cross-sectional view of a part of the head provided on the printer, and corresponding to FIG. 3A.
Figure 7B:
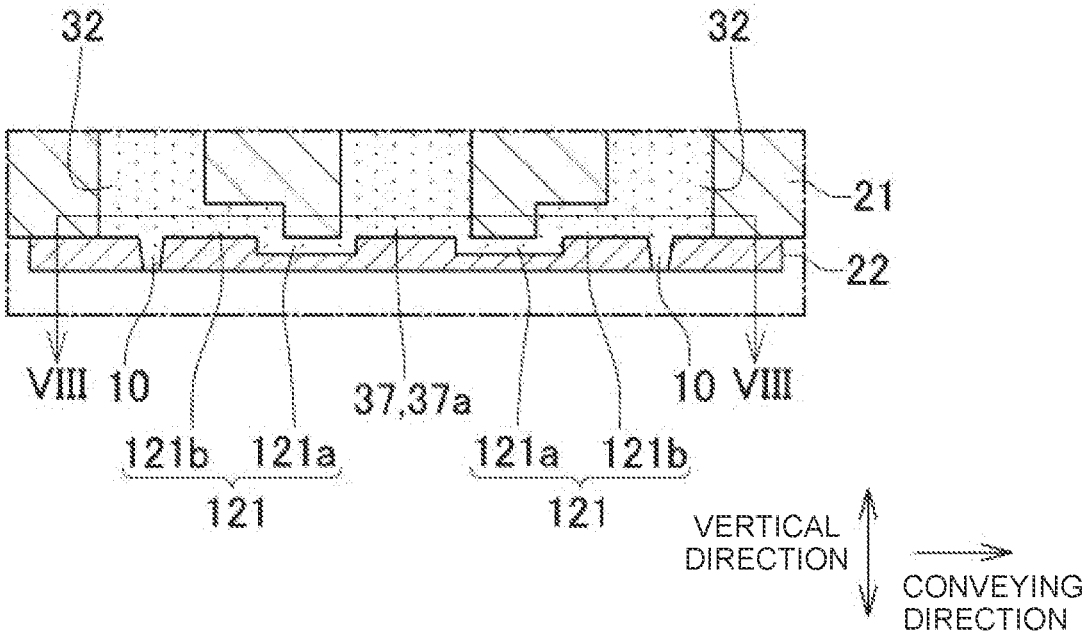
FIG. 7B is an enlarge view of a VIIB part in FIG. 7A.
Figure 8:
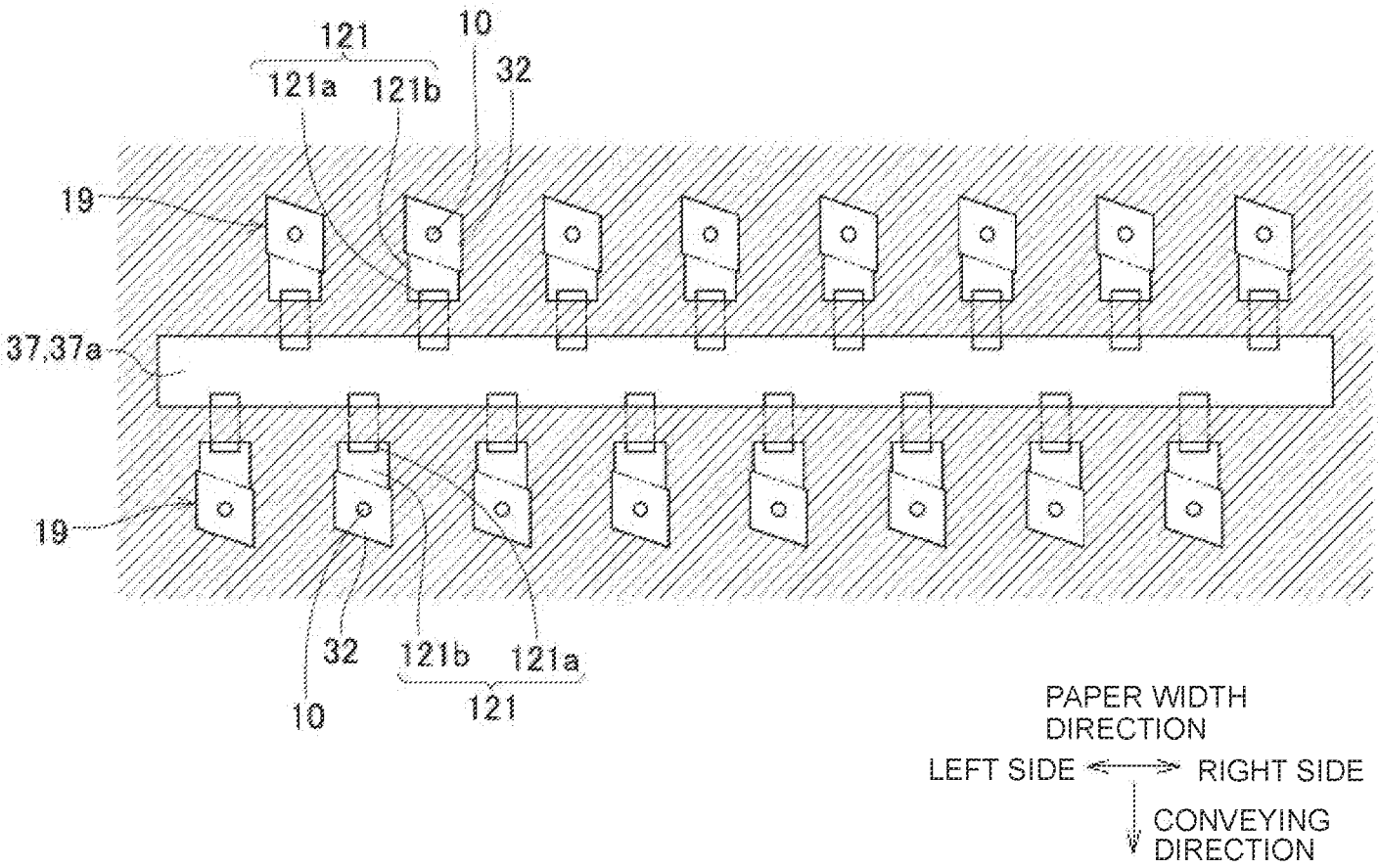
FIG. 8 is a cross-sectional view taken along a line VIII-VIII in FIG. 7B.

In a third modification, as depicted in FIGS. 7A and 7B and FIG. 8, a plurality of second throttles 121 are provided so that each of the plurality of second throttles 121 individually corresponds to one of the plurality of descenders 32. Note that in the third modification, the plurality of second throttles 121 corresponding to each of the individual channel rows 19 correspond to the "connection channel" of the present disclosure. Note that each of the plurality of second throttles 121 has a first channel part 121*a* and a second channel part 121*b*.

The first channel part 121*a* is formed in an upper part of the nozzle plate 22. The first channel part 121*a* extends parallel to the conveying direction, and an end on the inner side in the conveying direction of the first channel part 121*a* is connected to the second common channel 37.

The second channel part 121*b* is formed in a lower part of the channel substrate 21. The second channel part 121*b* extends in the conveying direction. An end on the inner side in the conveying direction of the second channel part 121*b* is connected to an end on the outer side in the conveying direction of the first channel part 121*a*. Further, an end on the outer side in the conveying direction of the second channel part 121*b* is connected to an end on the inner side in the conveying direction of a lower end part of a descender 32 included in the plurality of descenders 32 and which corresponds to the second channel part 121*b*.

Further, also in the third modification, it is possible to make the channel resistance in the second throttles 121 to be small, while securing the thickness of the partition wall 21*a* between the descender 32 and the second common channel 37 to thereby make the cross talk to less likely to occur.

Furthermore, in the above-described embodiment, although the first throttle 33 is formed in the channel substrate 21 and the first common channel 36 is formed across (in) the channel substrate 21, the pressure chamber plate 24 and the cover member 27, the present disclosure is not limited to this. For example, it is allowable that the first throttle 33 is formed in the pressure chamber plate 24, and that the first common channel 36 is formed only across (in) the pressure chamber plate 24 and the cover member 27.

Moreover, in the above-described embodiment, although the second channel part 34*b* formed in the channel substrate 21 extends parallel to the conveying direction, the present disclosure is not limited to this.

Figure 9:
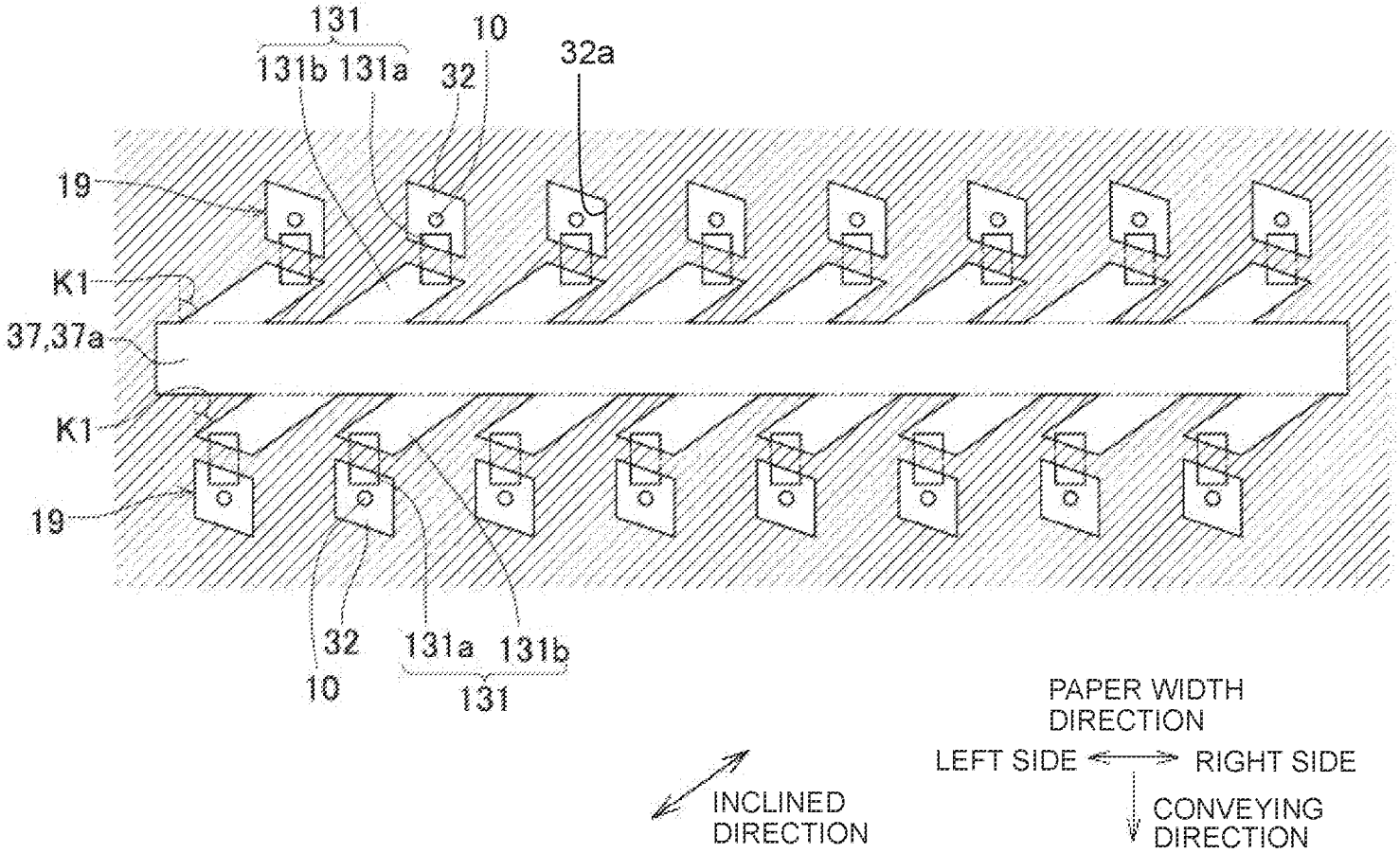
FIG. 9 is a cross-sectional view of a part of the head provided on the printer, and corresponding to FIG. 4.

In a fourth modification, a direction of a normal vector of a (110) plane of the channel substrate 21 which is formed of silicon is parallel to the vertical direction. Further, in the fourth modification, as depicted in FIG. 9, a second throttle 131 has a first channel part 131*a* and a second channel part 131*b*. The first channel part 131*a* is similar to the first channel part 34*a* of the above-described embodiment. The second channel part 131*b* extends in an inclination direction inclined with respect to the conveying direction by an angle K1 so that the second channel part 131*b* is inclined further toward the right side in the paper width direction as the second channel part 131*b* approaches closer to the upstream side in the conveying direction. The inclination direction is orthogonal to the vertical direction, and is inclined with respect to the paper width direction and the conveying direction (crosses the paper width direction and the conveying direction). The angle K1 is a smaller angle of the angles formed between the conveying direction and the inclination direction; the angle K1 is, for example, approximately 55 degrees. An end on the outer side in the inclination direction of the second channel part 131*b* is connected to an end on the inner side in the conveying direction of the first channel part 131*a*. An end on the inner side in the inclination direction of the second channel part 131*b* is connected to the second common channel 37.

In the fourth modification, the channel substrate 21 is formed of silicon, and the direction of the normal vector of the (110) plane of the channel substrate 21 is parallel to the vertical direction. On the other hand, the descender 32 penetrating the channel substrate 21 in the vertical direction has the inner wall surfaces 32*a* which are parallel to both of the vertical direction and the conveying direction, whereas the second channel part 131*b* formed in the channel substrate 21 extends in the inclination direction inclined with respect to the conveying direction by the angle K1. The angle K1 is approximately 55 degrees. With this, it is possible to form the descender 32 and the second channel part 131*b* by the wet etching; further, in a case that the second channel part 131*b* is formed by the wet etching, the (110) plane of the channel substrate 21 becomes to be a stopper surface for the wet etching. With this, it is possible to form the second channel part 131*b* easily and at a low cost. The second channel part 131*b* has an inner wall surface which is parallel to the inclination direction and the vertical direction. The inner wall surface is formed of the (110) plane of the channel substrate 21.

Furthermore, in the fourth modification, although the direction of the normal vector of the (110) plane of the channel substrate 21 which is formed of silicon is parallel to the vertical direction, and the second channel part 131*b* of the second throttle 131 extends while being inclined with respect to the conveying direction by the angle of 55 degrees, the present disclosure is not limited to this.

For example, the second channel part 131*b* may extend while being inclined with respect to the conveying direction by another angle in a range of 50 degrees to 60 degrees.

Alternatively, it is allowable that the channel substrate 21 is arranged in a direction which is different from the direction in which the direction of the normal vector of the (110) plane of the channel substrate 21 is parallel to the vertical direction. In this case also, by making the descender 32 penetrating the channel substrate 21 in the vertical direction to have the inner wall surface(s) parallel to the conveying direction, and by appropriately setting the orientations of the respective crystal faces (crystal planes) of the channel substrate 21 and the inclination angle of the second channel part 131*b* with respect to the conveying direction, it is possible to form the second channel part 131*b* with a high precision, depending on the crystal orientation of the channel substrate 21.

Further, although the foregoing explanation has been given about the example wherein the present disclosure is applied to the head which discharges or ejects the ink(s) from the nozzles, the present disclosure is not limited to this. For example, it is also possible to apply the present disclosure to a liquid discharging head which is configured to discharge a liquid different from the ink.

Note that the above-described embodiment and respective modifications may be combined with each other as long as the embodiment and respective modifications are not mutually exclusive.

What is claimed is:

1. A liquid discharging head comprising:

a first common channel;

a second common channel; and a plurality of individual channels which communicate with the first common channel and the second common channel, wherein the plurality of individual channels have:

nozzles formed in a nozzle plate and aligned in a first direction;

pressure chambers which correspond to the nozzles respectively, which are formed in a pressure chamber plate and which communicate with the first common channel, the pressure chamber plate being arranged to be apart from the nozzle plate in a second direction orthogonal to the first direction;

descenders which are formed in a channel substrate arranged between the nozzle plate and the pressure chamber plate in the second direction, and which are aligned in the first direction, each of the descenders extending in the second direction to connect one of the nozzles and one of the pressure chambers corresponding to the one of the nozzles; and at least one connecting channel which connects at least one of the descenders and the second common channel, and which has:

at least one first channel part formed in the nozzle plate, and a second channel part formed in the channel substrate, connected to the at least one first channel part and having a length in the second direction which is shorter than that of the second common channel, and wherein the second common channel is formed in the channel substrate, overlaps with the descenders in a third direction orthogonal to both of the first direction and the second direction, and is partitioned from the descenders by a partition wall formed by the channel substrate.

2. The liquid discharging head according to claim 1, wherein the at least one first channel part is connected to the at least one of the descenders; and the second channel part connects the at least one first channel part and the second common channel.

3. The liquid discharging head according to claim 2, wherein the second channel part is connected to an end surface in the third direction of the second common channel; and an inner wall surface of the second channel part includes a ceiling surface which is on a side of the pressure chamber plate in the second direction, the ceiling surface having an inclined surface which is inclined with respect to the third direction so that the inclined surface approaches the pressure chamber plate in the second direction as the inclined surface approaches the second common channel in the third direction.

4. The liquid discharging head according to claim 3, wherein the ceiling surface further has a connecting surface which connects the inclined surface and the second common channel; and an angle formed between the inclined surface and the connecting surface is an obtuse angle.

5. The liquid discharging head according to claim 3, wherein the second direction is a vertical direction.

6. The liquid discharging head according to claim 1, wherein a channel resistance in the at least one connecting channel is smaller than a channel resistance in each of the nozzles.

7. The liquid discharging head according to claim 1, wherein the at least one connecting channel is provided as a plurality of connecting channels each of which corresponds to one of the descenders; and in the each of the plurality of connecting channels, the at least one first channel part is provided as one first channel part connected to one of the descenders corresponding thereto, and the second channel part connects the one first channel part and the second common channel.

8. The liquid discharging head according to claim 1, wherein the at least one connecting channel corresponds to two or more of the descenders which are adjacent to each other in the first direction; and in the at least one connecting channel, the at least one first channel part is provided as a plurality of first channel parts each of which is connected to one of the two or more of the descenders corresponding thereto, and the second channel part connects the plurality of first channel parts and the second common channel, and extends in the first direction across a range in which the plurality of first channel parts are present.

9. The liquid discharging head according to claim 1, wherein the at least one connecting channel is provided as one connecting channel corresponding to all of the descenders aligned in the first direction; and in the one connecting channel, the at least one first channel part is provided as a plurality of first channel parts each of which is connected to one of the descenders corresponding thereto, and the second channel part connects the plurality of first channel parts and the second common channel, and extends in the first direction across a range in which the all of the descenders are aligned.

10. The liquid discharging head according to claim 1, wherein the at least one first channel part is connected to the second common channel; and the second channel part connects the at least one first channel part and the at least one of the descenders.

11. The liquid discharging head according to claim 1, wherein the channel substrate is formed of silicon.

12. The liquid discharging head according to claim 11, wherein the descender penetrates the channel substrate in the second direction, and has an inner wall surface parallel to the second direction and the third direction; and the second channel part extends in an inclined direction which is orthogonal to the second direction and which is inclined with respect to the third direction.

13. The liquid discharging head according to claim 12, wherein a direction of a normal vector of a (110) plane of the silicon of the channel substrate is parallel to the second direction; and the inclined direction is inclined with respect to the third direction by an angle in a range of 50 degrees to 60 degrees.

14. The liquid discharging head according to claim 11, wherein a direction of a normal vector of a (110) plane of the silicon of the channel substrate is parallel to the second direction; and the second channel part has an inner wall surface which is parallel to both of the second direction and an inclined direction, the inclined direction being orthogonal to the second direction and inclined with respect to the third direction by an angle in a range of 50 degrees to 60 degrees.

* * * * *